US005435160A

United States Patent [19]

Linsalato et al.

[11] Patent Number: 5,435,160

[45] Date of Patent: Jul. 25, 1995

[54] KEY LOCKING INDICATOR

[76] Inventors: Randy Linsalato, 550 N. Hermosa Ave., Sierra Madre, Calif. 91024; Scott Alberts, 3074 N. Lima St., Burbank, Calif. 91504

[21] Appl. No.: 82,531

[22] Filed: Jun. 28, 1993

[51] Int. Cl.[6] ..... E05B 41/00

[52] U.S. Cl. ..... 70/408; 40/330; 70/432; 70/395; 70/438

[58] Field of Search ..... 70/431, 432, 401, 438, 70/456 R, 395; 40/330 X, 634; 116/307, 309, 319

[56] References Cited

U.S. PATENT DOCUMENTS

| | | | |
|---|---|---|---|
| 1,843,335 | 2/1932 | Oberfield | 70/432 |
| 2,083,859 | 6/1937 | North | 70/408 |
| 2,373,893 | 4/1945 | Hoenger | 70/432 |
| 4,403,487 | 9/1983 | Marty | 70/408 |
| 4,432,218 | 2/1984 | Hoener | 70/395 |
| 4,440,011 | 4/1984 | Klein | 70/432 |
| 4,631,943 | 12/1986 | Hoener | 70/408 |
| 4,936,896 | 6/1990 | Takatsuka | 70/432 |

*Primary Examiner*—Peter M. Cuomo
*Assistant Examiner*—Darnell M. Boucher

[57] ABSTRACT

A key locking indicator device usable with a key of conventional design for tactile and visual indication of whether the device was last used to look or unlock the look operated by the key. The device is of simple construction, embodies a minimum number of moving parts, and is easy to use.

14 Claims, 4 Drawing Sheets

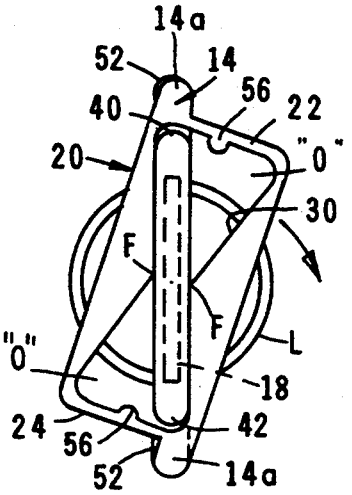
FIG. 7
FIG. 8
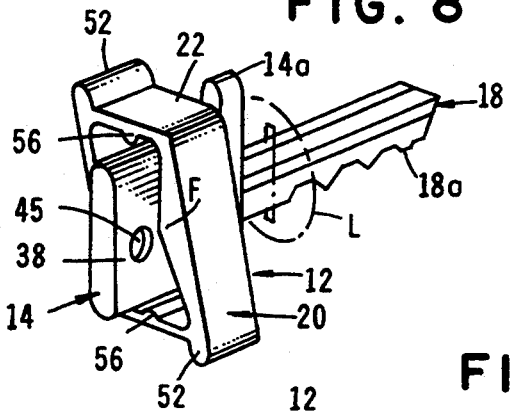
FIG. 9
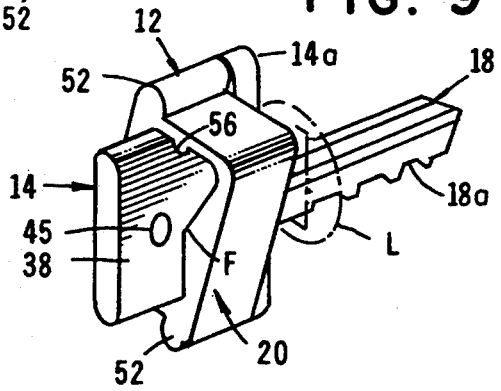
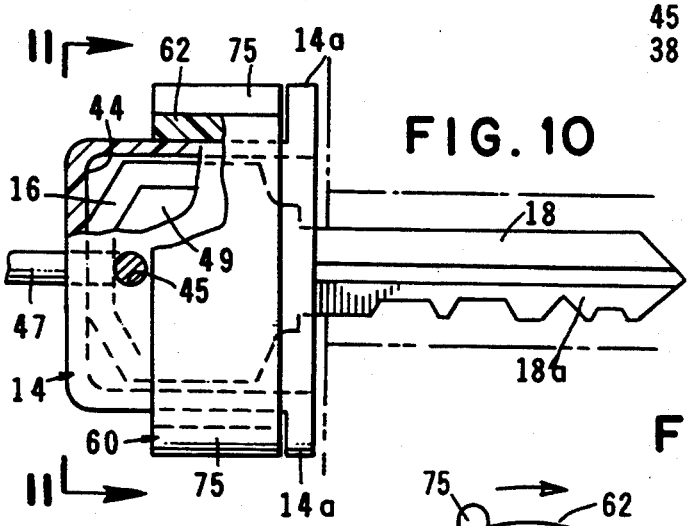
FIG. 10
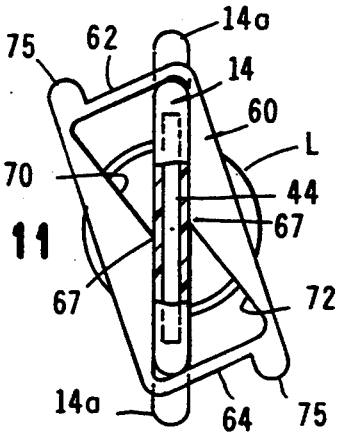
FIG. 11
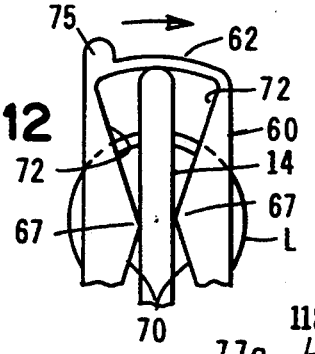
FIG. 12
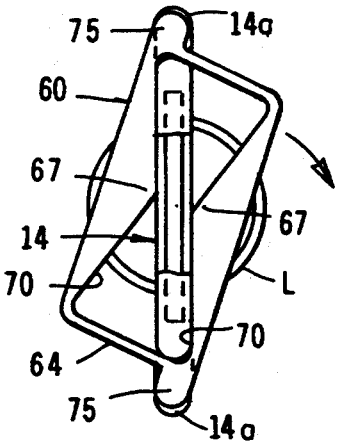
FIG. 13
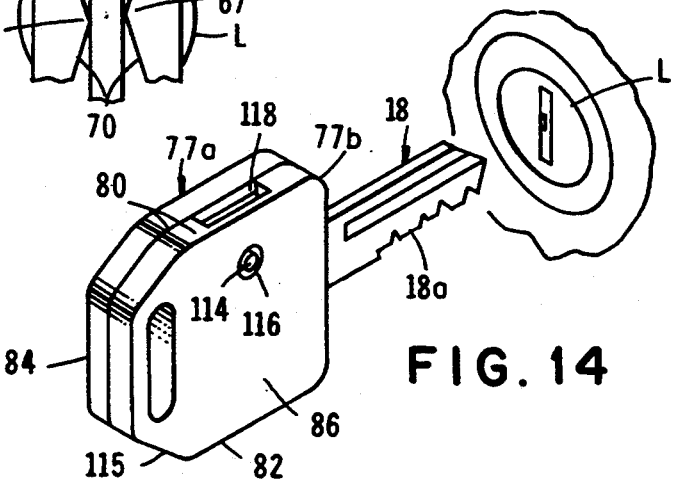
FIG. 14

KEY LOCKING INDICATOR

BACKGROUND OF THE INVENTION

1. Field of the Invention

The present invention relates to key locking devices. More particularly, the invention concerns a key locking indicator usable with a key of substantially conventional configuration for indicating whether the lock operated by the key has been locked.

2. Discussion of the Invention

Many people are uncertain, after leaving their homes or businesses establishments, whether or not they have locked the door upon leaving. This uncertainty frequently causes the person to return to their home or business establishment to verify that the door has been locked. This wastes time and creates unnecessary anxiety and frustration.

In the past, a number of devices have been suggested which indicate to the user whether the device was last used to lock the door or to unlock the door. Many of the prior art devices comprise a specially constructed key often having a key shank portion which is interconnected by a coupling mechanism with some type of indicating device. Exemplary of this type of device is that disclosed in U.S. Pat. No. 4,432,218 issued to Hoener. The Hoener device comprises a head member grippable by the fingers of the user, a shank member provided with a lock operating bit and coupling means enabling relative rotation of the members. A similar device of this character is also disclosed in U.S. Pat. No. 4,631,943 also issued to Hoener. This later device includes a head member and a cooperation shank member having a lock operating bit. The shank member is also provided with a shaft member rotatably lodged in a central bore of the head member.

Other prior art devices include various types of mechanical indicating mechanisms, such as pointers, dials, indicating pins and the like, which are connected to a conventional key. Exemplary of this class of device is that disclosed in U.S. Pat. No. 1,843,335 issued to Oberfield.

Still other prior art devices are unduly complex and often embody indicating devices that are of a very complicated construction having a large number of component parts.

A fundamental objective of the present invention is to provide a very simple indicating device that embodies an absolute minimum of moving parts.

SUMMARY OF THE INVENTION

It is an object of the present invention to provide a key locking indicator device that is usable with a key of generally standard configuration which will clearly indicate to the user whether the device has last been used to lock or unlock the lock operated by the key.

Another object of the invention is to provide a device of the aforementioned character which is easy to use, embodies a minimum number of moving parts and is simple and inexpensive to manufacture and assemble.

Another object of the invention is to provide a device of the class described which provides both a tactile and visual indication to the user of whether the device was last used to lock or unlock the key operated lock.

Another object of the invention is to provide a key locking indicator as described in the preceding paragraphs which is compact, lightweight, easy to use, and highly reliable in operation.

BRIEF DESCRIPTION OF THE DRAWINGS

FIG. 7 is an end view similar to FIG. 6 illustrating the configuration of the device after locking of the key lock has been accomplished.

FIG. 8 is a generally perspective view of the device in a first starting position.

FIG. 9 is a perspective view similar to FIG. 8 illustrating the appearance of the device in a second key lock position.

FIG. 10 is an enlarged side elevational view of the alternate embodiment of the invention partly broken away to show internal construction.

FIG. 11 is a view taken along lines 11—11 of FIG. 10.

FIG. 12 is a fragmentary end view similar to FIG. 11 showing the configuration of the device in an intermediate position.

FIG. 13 is an end view of the device similar to FIG. 11 but showing the device having moved from the first position into the second position.

FIG. 14 is a generally perspective, exploded view of yet another embodiment of the invention.

DESCRIPTION OF THE INVENTION

Figure 1:
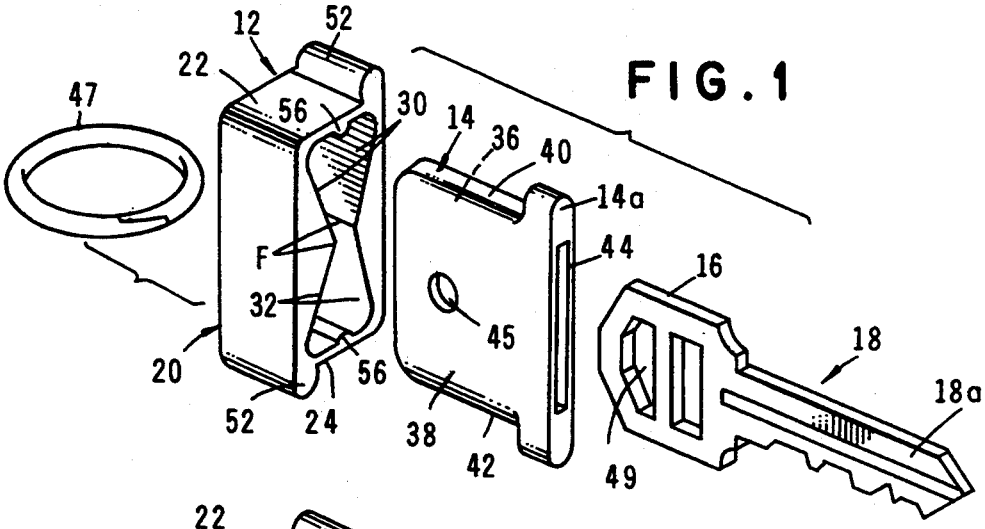
FIG. 1 is a generally perspective, exploded view of one embodiment of the key locking indicator of the invention.

Referring to the drawings and particularly to FIGS. 1 through 9, one form of the key locking indicator device of the present invention is there shown. As best seen by referring to FIGS. 1 and 2, the device of this form of the invention comprises finger engaging means, generally designated by the numeral 12, for engagement by the fingers of the user; a housing 14 having walls defining a cavity for closing receiving the head portion 16 of a key 18; and resistance means for yieldably resisting movement of the finger engaging means relative to the housing between a first position shown in FIG. 6 to a second position shown in FIG. 7.

The finger engaging means of the present embodiment includes a body 20 having interconnected top and bottom walls 22 and 24 respectively and side walls which cooperate to define a pair of spaced-apart, centrally disposed, fulcrums "F" the purpose of which will presently be described. The interconnected top, bottom and side walls define an opening in body 12 generally identified in FIG. 4 by the letter "0".

In the form of the invention shown in FIGS. 1 through 10, opening "O" in housing 20 is defined by first and second pairs of inwardly sloping walls which terminate in the previously identified, transversely spaced-apart first and second fulcrums "F". More particularly, the upper pair of side walls, generally designated in FIG. 1 by the numeral 30, extend downwardly from top wall 22 and slope inwardly, each terminating in a fulcrum line which extends longitudinally of body 20. A second, lower pair of walls, generally designated by the numeral 32, extend upwardly from bottom wall 24 and slope inwardly to terminate in the same fulcrum lines which define the pair of fulcrums "F" (see also FIG. 4).

Figure 4:
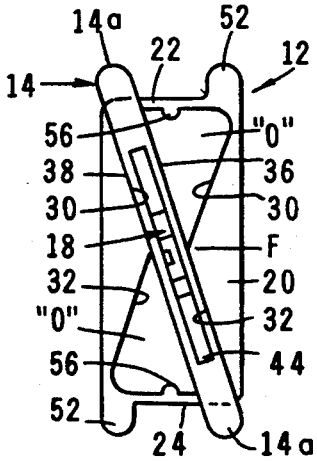
FIG. 4 is a front view of the assemblage.

As best seen in FIGS. 1 and 4, housing 14 comprises first and second generally parallel side walls 36 and 38 which, along with top and bottom portions 40 and 42, define a key head receiving cavity 44 (FIG. 1). Side walls 36 and 38 are provided with an aperture 45, the purpose of which will presently be described.

Figure 3:
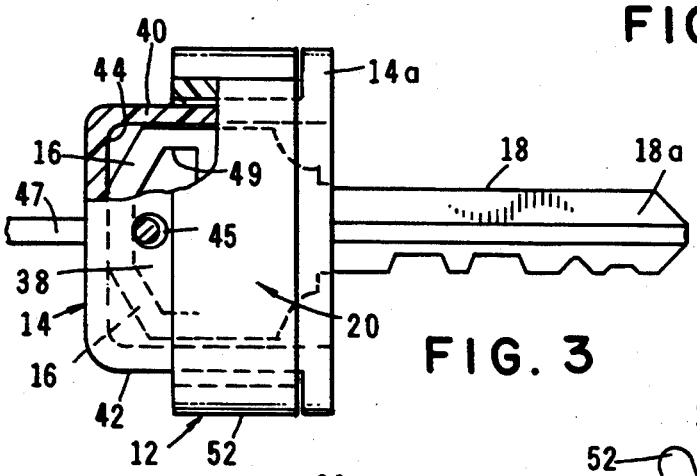
FIG. 3 is an enlarged, side-elevational view of the device partly broken away to show internal construction.

Turning to FIG. 3, it can be best seen that head 16 of key 18 is closely receivable within cavity 44 of housing 14 and is retained in position within the cavity by a split ring 47 which extends through aperture 45 and through an aperture 49 provided in key head 16. Split ring 47 is assembled with the housing and the key after housing 14 has been inserted into opening "O" in the body and fitted in between the transversely spaced fulcrums "F" (see also FIG. 4). Housing 14 is also provided with an enlarged forward portion **14*a* which abuts against body portion 12 of the finger engaging means when the housing is fully inserted within opening "O" so that split ring 47 can be conveniently inserted into locking position in the manner indicated in Figure 3**.

Figure 2:
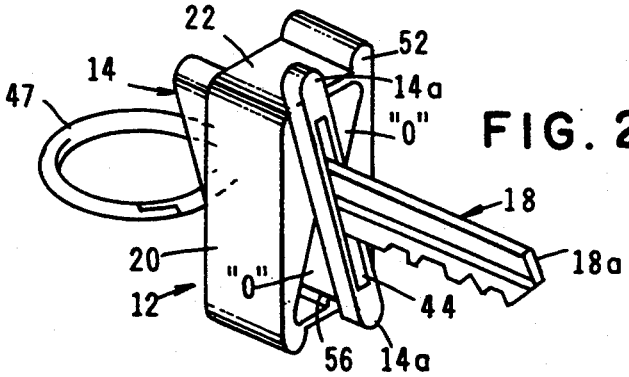
FIG. 2 is a generally perspective, assembled view of the embodiment of FIG. 1.

Once the key 18 has been assembled to the device of the invention in the manner shown in FIG. 2 and 3, the lock operating dit portion **18*a* of the key can be inserted into the lock "L" (FIG. 8). With the key inserted into the lock, the user grips the finger engaging means or body 20 and turns it in a clockwise direction as indicated by the arrow in FIG. 6. When the key reaches its full extent of travel, continuous forces exerted by the user's fingers on the finger engaging means will cause the assemblage to move into the second position shown in FIGS. 7 and 9. In locks of standard construction, the clockwise movement of the key and of the finger engaging means from the position shown in FIG. 8 to the position shown in FIG. 9** will move the lock into a locked position.

Forming an important aspect of the device of the invention is indicating means for indicating whether the finger engaging means is in the first or second position. In the form of the invention shown in FIGS. 1 through 10, this indicating means is provided in the form of outwardly extending protuberances 52 formed on top and bottom walls 22 and 24 of housing 20. As best seen by referring to FIG. 1 and 4, the protuberance formed on top wall 22 is located along the right edge of body 20 as viewed in FIG. 4, while the protuberance formed on bottom wall 24 is located on the left margin of body 20 as viewed in FIG. 4. As indicated in FIGS. 6 and 8, when the device is ready to be used to perform the key locking operation, protuberances 52 are out of alignment with portions **14*a* of housing 14. However, as shown in FIGS. 7 and 9, when the device is moved into locked alignment, body portion 20 has pivoted about fulcrums "F" into the position where portions 14*a* of the housing have moved into index or alignment with protuberances 52** thereby providing a tactile indication that the device has been used to accomplish the key locking step.

Figure 5:
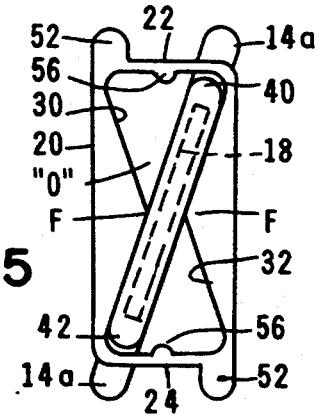
FIG. 5 is a rear view of the assemblage.
Figure 6:
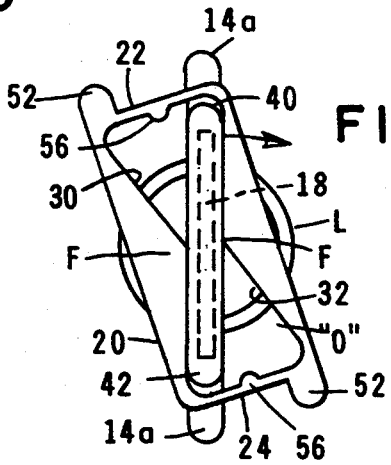
FIG. 6 is a view similar to FIG. 5 illustrating the direction of the movement of the finger engaging means toward a key locked position.

It is apparent that when the device is used to unlock lock "L", the reverse action will occur that is, the finger engaging means will pivot about the fulcrums "F" from the position shown in FIG. 7 to the position shown in FIG. 5. This movement of the finger engaging means about the fulcrum is, of course, caused by a rotational force exerted on the finger engaging means in an opposite or counterclockwise direction.

With this unique construction, the user of the device can at once determine whether or not the device was last used to lock the lock "L" by simply feeling or viewing the device to ascertain whether protuberances 52 are aligned or misaligned with portions **14*a***.

Also forming an important part of the apparatus of the form of the invention shown in FIGS. 1 through 10 is the provision of resistance means for yieldably resisting movement of the finger engaging means relative to housing 14 about spaced-apart fulcrums "F". In this embodiment of the invention, the resistance means is provided in the form of inwardly extending protuberances 56 formed on the inner surfaces of top and bottom walls 22 and 24. Protuberances 56 are constructed so as to frictionally engage walls 40 and 42 of housing 14 as the finger engaging means pivots about the fulcrums "F" from the first position to the second position. In operation, when the housing 14 engages the protuberances 56 during the key operating step, the top and bottom walls of the housing 20 will deform slightly permitting the housing 14 to pass by protuberances 56 upon the exertion of a sufficient force to slightly deform the upper and lower walls of the body 20 thereby permitting movement past the upper and lower walls of housing 14. To provide proper spring action, the finger engaging means is preferably constructed from a moldable plastic such as polyolefin.

Turning now to FIGS. 10 through 13, another embodiment of the key locking indicator device of the present invention is there illustrated. This device is similar in many respects to that described in the preceding paragraphs and like numerals are used to identify like components. The principal difference between this second embodiment of the invention and the earlier described embodiment resides in the nature of the resistance means which yieldably resists movement of the finger engaging means relative to the key receiving housing 14.

As best seen in FIG. 10, housing 14 is of identical construction to that previously described and is retained in position within the finger engaging means by a split ring 47 which is also of identical construction to that previously described. However, the finger engaging means of this latest form of the invention is of a slightly different construction and includes a body 60 having interconnected top, bottom and side walls. Top and bottom walls 62 and 64 are yieldably deformable out of plane from the position shown in FIG. 11 to the position shown in FIG. 12 as the finger engaging means pivots about transversely spaced-apart fulcrums 67. As before, fulcrums 67 are defined by upper and lower pairs of inwardly sloping walls generally designated in FIG. 11 by the numerals 70 and 72.

Body 60 can also be constructed from a variety of yieldably deformable plastics so that upper and lower walls 62 and 64 yieldably resist pivotal movement of the body portion from the first position to the second position and thereby provide resistance to the relative movement of housing 14 and body portion 60 of the finger engaging means during the key lock operating step.

As was the case in the previously described invention, indicating means are also here provided for indicating whether or not the finger engaging means is in the first or second position. These indicating means here comprise upper and lower protuberances 75 which are formed proximate the upper and lower edges of housing 60 (FIG. 11). As before, when the finger engaging means is pivoted relative to housing 14 to the locked position shown in FIG. 13, portions 14*a* of the housing will align with protuberances 75 thereby indicating that the device has last been used to accomplish the locking step.

Figure 17:
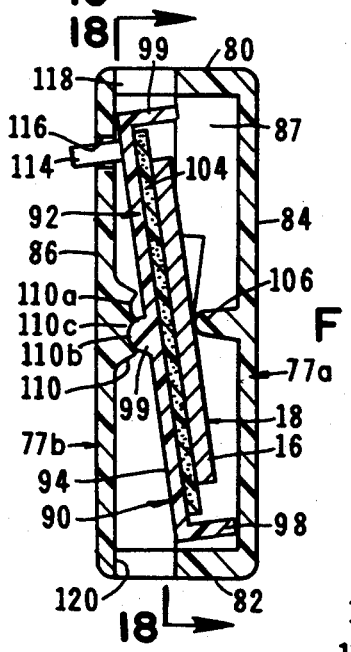
FIG. 17 is a view taken along lines 17—17 of FIG. 16.

Turning now to FIGS. 14 through 21, still another embodiment of the device of the invention is there illustrated. In this form of the invention, both the key receiving housing and the finger engaging means are of slightly different construction. More particularly, as best seen by FIGS. 14 and 17, the finger engaging means here comprises a pair of cooperating housing defining members 77*a* and 77*b*, each having interconnected top, bottom and side walls 80, 82, 84 and 86 respectively. These walls define an interior chamber 87 within which the key receiving housing is receivable in the manner best seen in FIGS. 16 and 17.

Figure 21:
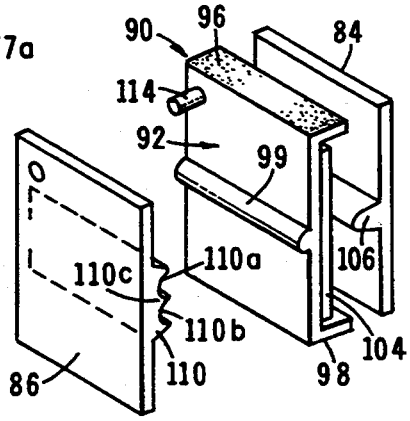
FIG. 21 is an exploded, generally perspective foreshortened view of the housing portion of this latest form of the invention.

The key receiving housing assembly, generally designated by the numeral 90, comprises a first member 92 which is generally U-shaped in cross section and includes a side wall 94 and top and bottom walls 96 and 98 (FIG. 21). As indicated in FIG. 21, wall 94 is provided with a longitudinally extending rib 99, the purpose of which will presently be described. Housing assembly 90 also includes a strip of double-sided, foam tape 104 (FIG. 16), one side of which adheres to the face of member 92 opposite face 94 upon which rib 99 is formed. The other side of the doubled sided tape holds key head 16 in position within assembly 90.

Figure 20:
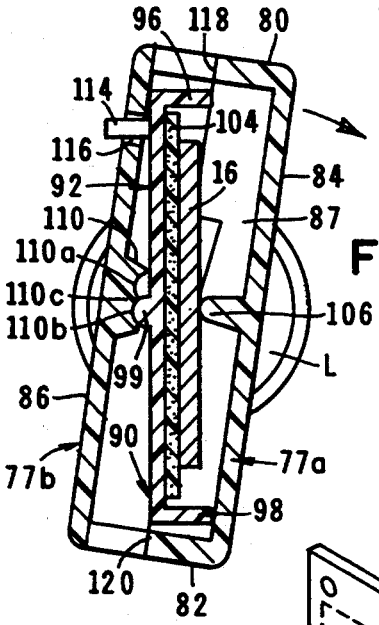
FIG. 20 is a cross-sectional view similar to that shown in FIG. 17 illustrating the direction of movement necessary to return the device to the locked position wherein there is visual indication that the key is in the locked position.
Figure 19:
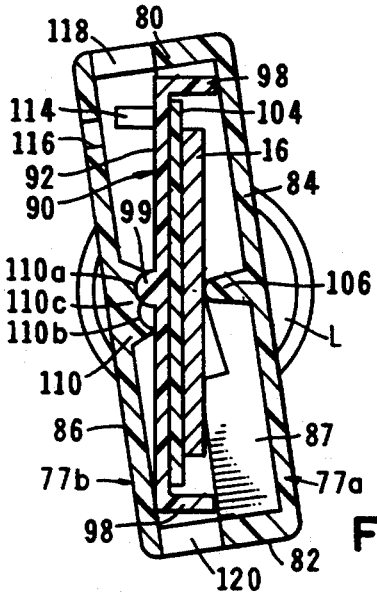
FIG. 19 is a cross-sectional view similar to FIG. 17 showing the device having moved from a first position shown in FIG. 17 to a second position shown in FIG. 19.

Provided on side wall 84 of the finger engaging means is a protuberance 106 which extends into chamber 87 (FIG. 20) and is adapted to engage key head 16. In the form of the invention shown in FIGS. 20 and 21, protuberance 106 comprises one of the fulcrums about which the key and key housing pivot in a manner presently to be described. Provided on the interior surface of side wall 86 is a protuberance 110 which is provided with first and second longitudinally extending, side by side grooves 110*a* and 110*b*. In the manner indicated in FIGS. 19 and 21, grooves 110*a* and 110*b* alternately receive rib 99 as the finger engaging means of this form of the invention pivots about fulcrum or protuberance 106 from the first position shown in FIG. 19 to the second position shown in FIG. 20. More particularly, a comparison of FIGS. 19 and 20 show that when the key and housing assembly therefor is in the first position, rib 99 resides within groove 110*a*. Conversely, when the key and housing subassembly is in the second position shown in FIG. 20, rib 99 resides in groove 110*b* having ridden over the upstanding separation 110*c* which separates grooves 110*a* and 110*b* (FIG. 21).

Figure 15:
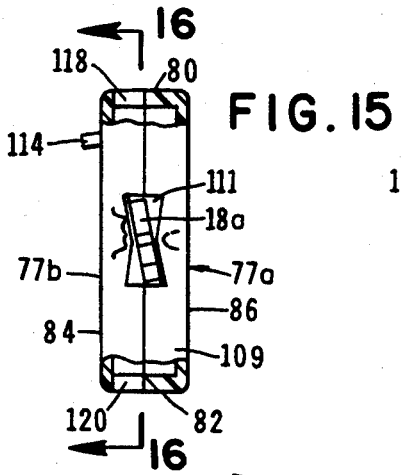
FIG. 15 is a front view of the device shown in FIG. 14 partly broken away to show internal construction.
Figure 16:
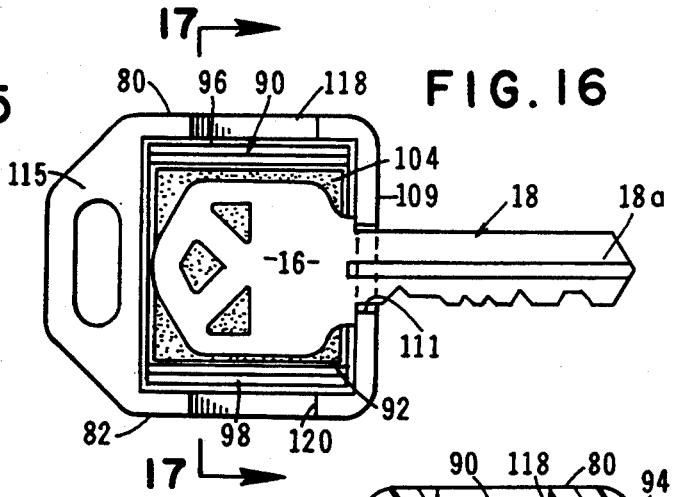
FIG. 16 is a view taken along lines 16—16 of FIG. 15.

In assembling the device of this latest form of the invention, the double-backed, adhesive foam tape 104 is first affixed to the inner wall of member 92 in the manner shown in FIG. 19. Next the key head 16 is pressed against the adhesive foam 104 so that the bit portion 18*a* of key 18 extends through an opening 110 provided in the forward face 109 of the finger engaging means (FIG. 15). The assemblage thus formed is then mated with side wall 86 so that rib 99 resides within groove 110*a* of protuberance 110 in the manner shown in FIG. 19. The second half of the finger engaging means of this form of the invention is then mated with the first half so that fulcrum or protuberance 106 pressurally engages key head 16 which adheres to adhesive foam member 104.

As best seen in FIGS. 19 and 21, wall 92 is provided with a cylindrically shaped, outwardly extending indicator element 114 which is aligned with an aperture 116 provided in wall 86 of the finger engaging means. This indicator element 114 forms a part of the indicating means of this form of the invention for indicating whether the finger engaging means is in the first or second position.

With the device assembled in the manner shown in FIG. 19, and with the key bit 18*a* in lock "L", a force exerted on the finger engaging means in the direction of the arrow of FIG. 20 will cause rib 99 to snap from groove 110*a* into 110*b* as it overrides central portion 110*c*. In this position, indicator element 114 extends through aperture 116 so that by feel the user can determine that the housing and key assemblage are in the second or locked position.

In this latest form of the invention, the indicating means also comprises a visual means for identifying the position of the key retaining housing. More particularly, as indicated in FIG. 21, wall 96 of the housing assembly can be colored as, for example, with a red color which is easily visible through an opening 118 provided in top wall 80 of the finger engaging means (FIG. 14). When the user can see the red surfaced wall 96 through the opening 118, he or she knows immediately that the device is in the second or key-locked position. Similarly, lower wall 98 of the housing assembly can be painted green and can be viewed through an opening 120 provided in wall 82 of the finger engaging means. When the green surface is viewable through opening 120, the indication to the user is that the device is in the first or unlocked position. Thusly, in the last described embodiment of the invention, the indicating means is both tactile and visual. The tactile portion being the ability to perceive indicating element 114 extending through aperture 116 and the visual portion being the ability to view either the red or green surfaces through apertures 118 and 120.

Figure 18:
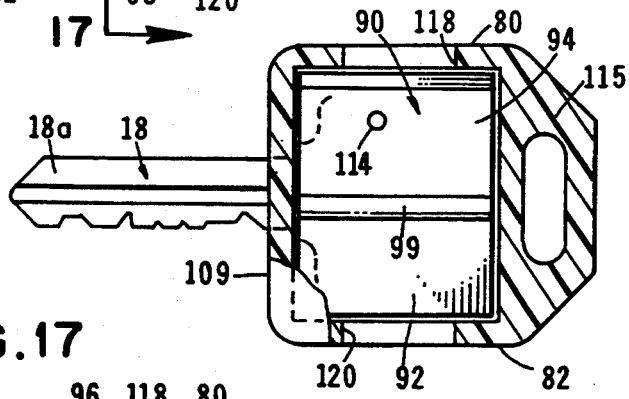
FIG. 18 is a view taken along lines 18—18 of FIG. 17.

To conveniently carry the device of this latest form of the invention on a key ring, the finger engaging housing is provided with an outwardly extending apertured portion 115 (FIG. 18).

Figure 22:
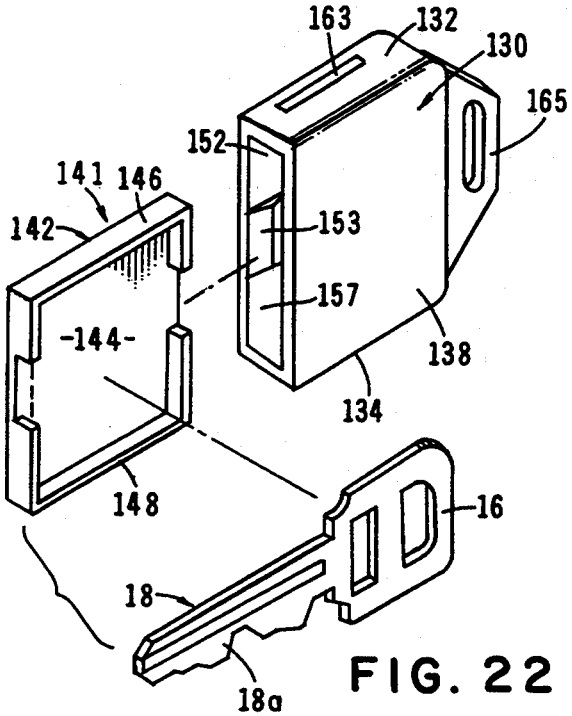
FIG. 22 is an exploded, generally perspective view of still another embodiment of the invention.
Figure 23:
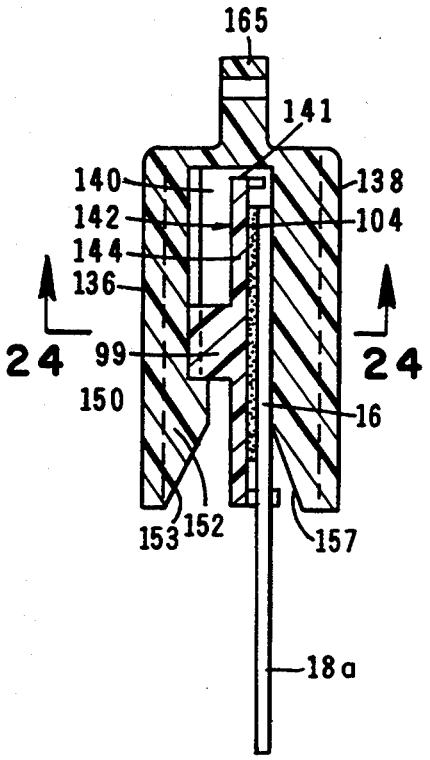
FIG. 23 is a longitudinal, cross-sectional view of the device of FIG. 22.
Figure 24:
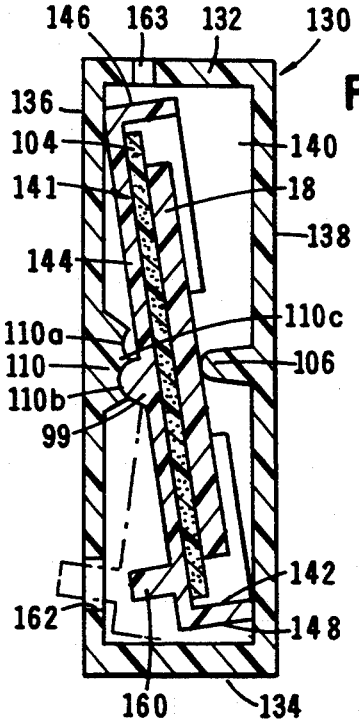
FIG. 24 is a cross-sectional view taken along lines 24—24 of FIG. 23.

Referring to FIGS. 22 through 24, yet another embodiment of the device of the invention is there illustrated. This form of the invention is similar in many respects to that just described and like numerals are used to identify like components. The finger engaging means here comprises a housing 130 having interconnected top, bottom and side walls 132, 134, 136 and 138 respectively. These walls define an interior chamber 140 within which the key receiving housing is receivable.

The key receiving housing assembly, generally designated by the numeral 141, is very similar to housing 90, and comprises a first member 142 which is generally U-shaped in cross section and includes a side wall 144 and top and bottom walls 146 and 148 (FIG. 24). As indicated in FIG. 24, wall 144 is provided with a longitudinally extending rib 99. Housing assembly 141 also includes a strip of double-sided, foam tape 104 (FIG. 24), one side of which adheres to the face of member 141 opposite face 144 upon which rib 99 is formed. The other side of the doubled sided tape holds key head 16 firmly in position within assembly 141.

Provided on side wall 138 of the finger engaging means is a protuberance 106 which extends into chamber 140 (FIG. 24) and is adapted to engage key head 16. As before, protuberance 106 comprises one of the fulcrums about which the key and key housing pivot in a manner earlier described. Provided on the interior surface of side wall 136 is a protuberance 110 which is provided with first and second longitudinally extending, side by side grooves 110*a* and 110*b*. As before, grooves 110*a* and 110*b* alternately receive rib 99 as the finger engaging means of this form of the invention pivots about fulcrum or protuberance 106 from the first position to the second position.

Assembly of the key to the key housing in the device of this latest form of the invention, is also as previously described. However, the assembly of the key housing portion to the finger engaging means is different because of the different, one piece construction of the finger engaging means. Further, the finger engaging means is provided with an interiorly disposed locking shoulder 150 (FIG. 23) which extends inwardly of chamber 140. Shoulder 150 is formed at the inner extremity of a ramp-like, inwardly-extending element 152 which includes a forward tapered surface 153. With this construction, the assembled key and key housing can be introduced into the open mouth 157 of the finger engaging means and pushed over ramp 152 until it snaps in place behind shoulder 150 in the manner shown in FIG. 23.

As best seen in FIG. 24, wall 144 of the key housing is provided with a cylindrically shaped, outwardly extending indicator element 160 which is aligned with an aperture 162 provided in lower portion of wall 136 of the finger engaging means. This indicator element 160 forms a part of the indicating means of this latest form of the invention for indicating whether the finger engaging means is in the first or second position.

With the device assembled in the manner shown in FIGS. 23 and 24 and with the key bit 18*a* in lock "L", a turning force exerted on the finger engaging means in a clockwise direction will cause rib 99 to snap from groove 110*a* into 110*b* as it overrides central portion 110*c*. In this position, indicator element 160 will extend through aperture 162 so that by feel the user can determine that the housing and key assemblage are in the second or locked position.

In this latest form of the invention, the indicating means also comprises a visual means for identifying the position of the key retaining housing. More particularly, as shown in FIG. 22, top wall 132 is provided with an opening 163 for viewing the top wall 146 of the key housing when the device is in the first or unlocked position.

To conveniently carry the device of this latest form of the invention on a key ring, the finger engaging housing is provided with an outwardly extending apertured flange portion 165 (FIG. 22).

Figure 25:
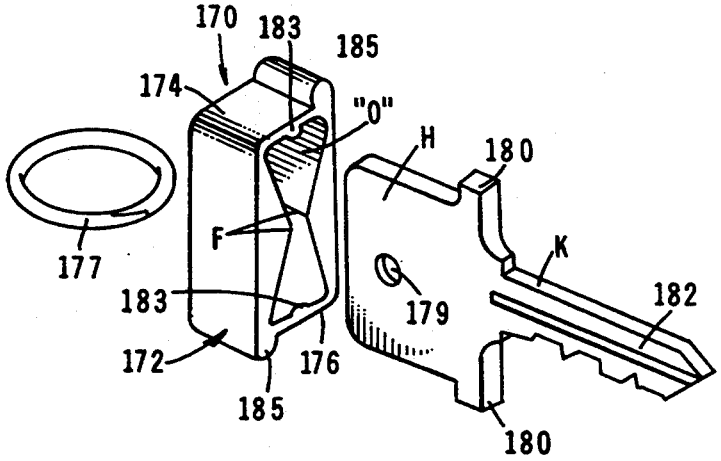
FIG. 25 is a generally perspective view of still another form of the apparatus of the invention.

Turning now to FIG. 25 of the drawings, yet another form of the key locking indicator device of the present invention is there shown. The device of this form of the invention is similar in many respects to that shown in FIG. 1 save that the housing 14 for receiving the key has been eliminated. The finger engaging means, generally designated by the numeral 170 is virtually identical to that previously described in connection with the FIGS. 1 through 10 and includes a body 172 having interconnected top and bottom walls 174 and 176 respectively and side walls which cooperate to define a pair of spaced-apart, centrally disposed, fulcrums "F" which function in the same general manner as previously described. The interconnected top, bottom and side walls define an opening in body 12 generally identified in Figure 4 by the letter "O".

As before, opening "O" in the housing is defined by first and second pairs of inwardly sloping walls which terminate in the transversely spaced-apart first and second fulcrums "F". More particularly, the upper pair of side walls extend downwardly from top wall 174 and slope inwardly, each terminating in a fulcrum line which extends longitudinally of body. A second, lower pair of walls extend upwardly from bottom wall 176 and slope inwardly to terminate in the same fulcrum lines which define the pair of fulcrums "F". However, in this latest embodiment, the fulcrums are slightly closer together to closely accept the head "H" of the key itself. With this construction, the head "H" of key "K" is itself closely receivable between the fulcrums "F" disposed within cavity "O" of body 172 and is retained in position within the cavity by a split ring which extends through aperture 179 provided in key head "H". Split ring 177 is assembled with the housing and the key after the key has been inserted into opening "O" in the body and fitted in between the transversely spaced fulcrums "F". As indicated in FIG. 25, key "K" is of generally standard construction but is here provided with outwardly extending indicating protuberances, or ears, 190, the purpose of which will presently be described.

Once the key "K" has been assembled to body 172, the lock operating bit portion 182 of the key can be inserted into the lock. With the key inserted into the lock, the user grips the finger engaging means or body 172 and turns it in a clockwise direction. When the key reaches its full extend of travel, continuous forces exerted by the user's fingers on the resistance means or finger engaging means will cause the key to move past the protuberances 183 formed on top and bottom walls 174 and 176 and into the second position.

In the form of the invention shown in FIG. 25, the indicating means is, as before, provided in the form of outwardly extending protuberances 185 formed on top and bottom walls 174 and 176 of body 172. When the device is ready to be used to perform the key locking operation, protuberances 185 are out of alignment with portions 180 of key "K". However, as shown in FIGS. 7 and 9 when the device is moved into locked alignment body portion 172 has pivoted about fulcrums "F" into the position where portions 180 of the key have moved into index or alignment with protuberances 185 thereby providing a tactile indication that the device has been used to accomplish the key locking step.

When the lock "L" is unlocked, the reverse action will, of course, occur.

It is to be understood that in all of the previously described embodiments of the invention which include indicator members or color bands, the key assembly can be turned over to accommodate locks which lock in the counter-clockwise rather than clockwise direction. In the embodiments of FIGS. 1 through 10 and 25 m the body itself can be turned over to accommodate counter-clockwise locking locks.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A combination key and key locking indicator apparatus for use in operating a lock, comprising:

(a) finger engaging means for engagement by the fingers of a user including a body having an opening therein and a fulcrum disposed within said opening, said body of said finger engaging means including first and second opposing sidewalls, said first and second side walls, each having a fulcrum formed thereon;

(b) a key member, including a head portion and a lock operating bit portion, said head portion having outwardly extending indicating protuberances, said head portion of said key member being receivable within the opening in said body between said fulcrums, said finger engaging means being movable relative to said key member between first and second positions; and (c) resistance means for yieldably resisting movement of said finger engaging means relative to said key member between said first and second positions.

2. A device as defined in claim 1 further including retaining means for retaining said portion of said key within said finger engaging means.

3. A key locking indicator apparatus for use in operating a lock, comprising:

(a) finger engaging means for engagement by the fingers of a user including a body having an opening therein and a fulcrum disposed within said opening, said opening being defined by first and second pairs of inwardly sloping walls, said walls terminating in spaced apart first and second fulcrums;

(b) a housing having walls defining a cavity for closely receiving the head portion of the key, said housing being receivable within the opening in said body with one of said walls thereof being in engagement with said fulcrums, said finger engaging means being movable relative to said housing between first and second positions; and (c) resistance means for yieldably resisting movement of said finger engaging means relative to said key member between said first and second positions.

4. A device as defined in claim 3 in which said body of said finger engaging means includes sidewalls and in which said fulcrum is formed on one of said side walls.

5. A device as defined in claim 3 further including indicating means for indicating whether said finger engaging means is in said first or second position.

6. A device as defined in claim 3 further including retaining means for retaining the head portion of the key within the cavity of said housing.

7. A device as defined in claim 3 in which said body of said finger engaging means includes interconnected top, bottom and side walls, said side walls being generally parallel, one of said side walls being in engagement with said first fulcrum and the other of said walls being in engagement with said second fulcrum.

8. A device as defined in claim 7 in which said resistance means comprises at least one protuberance formed on said housing and extending into the opening formed therein.

9. A key indicator device for use with a key of standard configuration having ahead portion and a lock operating bit portion, said indicator comprising:

(a) finger engaging means for engagement by the fingers of a user including a body having interconnected top, bottom and side walls, each said side wall having a fulcrum defining protuberance extending into said interior opening, one of said fulcrum defining protuberances having first and second grooves provided therein;

(b) a housing having first and second walls defining a cavity for closely receiving the head portion of the key, said housing being receivable within the opening in said body, said first wall thereof being in engagement with said fulcrum, said finger engaging means being movable relative to said housing between first and second positions;

(c) resistance means for yieldably resisting movement of said finger engaging means relative to said housing between said first and second positions, said resistance means comprising a rib formed on said second wall of said housing, said rib being alternately receivable within said grooves of said one of said fulcrum defining protuberances as said finger engaging means is movable between said first and second positions; and (d) indicating means for indicating whether said finger engaging means is in said first or second position.

10. A device as defined in claim 9 in which said side wall of said body having said protuberance is also provided with an aperture therethrough and in which said indicating means comprises an indicator element provided on said second wall of said housing, said indicator element being receivable within said aperture when said finger engaging means is in one of said first and second positions.

11. A key locking indicator device for use with a key of standard configuration having head portion and a lock operating bit portion, said indicator device comprising:

(a) finger engaging means for engagement by the fingers of a user including a body having a top, bottom and side walls defining an opening, each of said side walls having a fulcrum defining protuberance extending into said opening;

(b) a housing having walls defining a cavity for closely receiving the head portion of the key, one of said walls of said housing being in engagement with one of said fulcrum defining protuberances, said finger engaging means being movable relative to said housing between first and second positions; and (c) resistance means for yieldably resisting movement of said finger engaging means relative to said housing from said first position to said second position.

12. A device as defined in claim 11 further including indicating means for indicating the position of said finger engaging means.

13. A device as defined in claim 12 in which said indicating means comprises an indicating element provided on one of said walls of said housing.

14. A combination key and key locking indicator apparatus for use in operating a lock, comprising:

(a) finger engaging means for engagement by the fingers of a user including a body having an opening therein and a fulcrum disposed within said opening, said body of said finger engaging means including first and second opposing sidewalls, said first and second side walls each having a fulcrum formed thereon;

(b) a key-member, including a head portion and a lock operating bit portion, said head portion having at least one extending indicating protuberance, said head portion of said key member being receivable within the opening in said body between said fulcrums, said finger engaging means being movable relative to said key member between first and second positions; and (c) resistance means for yieldably resisting movement of said finger engaging means relative to said key member between said first and second positions.

* * * * *